United States Patent [19]

Cellai

[11] Patent Number: 4,492,168

[45] Date of Patent: Jan. 8, 1985

[54] AUTOMATIC SELF-PROPELLED DEVICES FOR TRAVELLING ON A TRACK CABLE

[76] Inventor: Stelvio S. Cellai, Villa "Alba Chiara" 23, Avenue Mohamed El Karoui, Sousse, Tunisia

[21] Appl. No.: 199,298

[22] Filed: Oct. 21, 1980

[30] Foreign Application Priority Data

Oct. 24, 1979 [FR] France ..... 79 26940

[51] Int. Cl.[3] ..... B61B 7/06; B61C 11/02; B61C 13/06

[52] U.S. Cl. ..... 105/30; 105/153

[58] Field of Search ..... 105/30, 153

[56] References Cited

U.S. PATENT DOCUMENTS

| | | | |
|---|---|---|---|
| 596,015 | 12/1897 | Cook | 105/153 X |
| 1,987,104 | 1/1935 | Guthrie | 105/30 |
| 2,038,732 | 4/1936 | Guthrie | 105/30 |
| 2,228,034 | 1/1941 | Nelles | 105/30 |
| 2,312,518 | 3/1943 | Baldwin | 105/30 |
| 3,498,236 | 3/1970 | Meek | 105/30 |
| 3,518,947 | 7/1970 | Borst | 105/30 |
| 3,533,357 | 10/1970 | Brandon | 105/153 X |

FOREIGN PATENT DOCUMENTS

| | | | |
|---|---|---|---|
| 766058 | 4/1934 | France | 105/153 |
| 1279934 | 11/1961 | France | 105/153 |
| 1388670 | 1/1965 | France | 105/153 |
| 1554769 | 12/1968 | France | 105/153 |
| 1569287 | 4/1969 | France | 105/153 |
| 2042229 | 1/1971 | France | 105/153 |

*Primary Examiner*—Bruce H. Stoner, Jr.
*Assistant Examiner*—Howard Beltran
*Attorney, Agent, or Firm*—Young & Thompson

[57] ABSTRACT

A self-propelled device prevents any sliding on a track cable, no matter what the slope of the latter, by means of a dynamic clamping action which is self-gripping, self-stabilizing, self-controlled and proportional to the load. The device comprises a device for the automatic coupling and uncoupling of the engine, an end of travel automatic braking device and an automatic control device for lowering the speed in the case of a breakdown on a steep slope. The device can be used for the overhead hauling and transportation of various loads (lifting, handling, lumbering, civil engineering). It could also be used for transporting people (self-propelled ropeway or ski lift), as well as for the installation of small cables during the installation and maintenance of electric power lines.

7 Claims, 5 Drawing Figures

AUTOMATIC SELF-PROPELLED DEVICES FOR TRAVELLING ON A TRACK CABLE

BACKGROUND OF THE INVENTION

The present invention relates to equipment such as self-propelled cableways travelling on track cables or rails, together with cable installation equipment.

Cableways are frequently used for transporting loads across uneven ground, for example in lumbering and civil engineering. They are based on the principle of the ropeway which requires the use of large winches at one of the ends of the run for pulling the cable. However, such installations have the disadvantage of being heavy, difficult to transport and move and therefore very costly.

Self-propelled equipment travelling on a fixed cable would not require a cable hauling winch located at one of the ends of the run. The installation would be much simpler and easier to dismantle, because it would merely be necessary to stretch a fixed cable between two points. However, the self-propelled equipment travelling along the fixed cable must only have a limited weight.

For installing the conducting cables of a high voltage line a first small cable is installed beforehand between two towers. Once held taut between two supports, the small cable is used for pulling a second cable with a larger cross-section and so on until the final cable pulls the conducting cable. When the ground is negotiable, it is possible to unwind the first small cable from one tower to the next by means of a random heavy vehicle. However, when it becomes difficult to travel along the ground with conventional vehicles, for example when it is a question of crossing valleys, rivers, lakes, mountainous areas, marshes, etc. it is necessary either to use a boat for rivers or a helicopter. However, the use of such vehicles suffers from the disadvantage that they are costly and dangerous. When the helicopter pulls the small cable behind it, the latter could possibly attach itself to a tree or be displaced by a gust of wind, so that the helicopter would lose its balance. The danger is made greater by the fact that the operation must be carried out for each cable.

Various attempts have been made to provide self-propelled means but all have disadvantages, reference being made in an exemplified manner to:

U.S. Pat. No. 3,498,236 (MEEK) discloses a self-propelled device which has only a mediocre adhesion to the cable because the pivot pin of the clamping lever is located in front of the means, leading to poor stability and sliding when transporting loads.

SUMMARY OF THE INVENTION

The object of the present invention is to provide a self-propelled device which makes it possible to obviate the above-mentioned disadvantages. The device travels along a first cable installed by the aforementioned means and is able to transport loads and pull other cables.

According to the invention, there is provided a self-propelled device adapted for travelling on a track cable, said device comprising at least one driving endless track or wheel applied to the upper surface of said track cable, at least one wheel applied to the lower surface of said track cable, a device for applying said endless track or wheel to said cable having a lever to which are connected the axle of said wheel applied beneath the cable, and an attachment member for a load to be transported or hauled by the device, said lever having a pivot pin suspended from a frame of the device.

The self-propelled device according to the invention is characterized by:

its lightness in that only one person is required for lifting it and placing it on the track cable;

its limited overall dimension;

the possibility of transporting loads perpendicular to the direction of forward travel determined by the supporting cable, as well as hauling loads parallel thereto without sliding, no matter what the inclination relative to the ground of the supporting cable along which the equipment travels;

the possibility of both forward and reverse travel;

the possibility of being remotely controlled;

the automatic nature of its operations consisting of:

- stopping without the engine stopping if the load parallel to the forward movement direction exceeds the prescribed maximum value and starting up again as soon as the said load is again below the maximum value;
- stopping at the end of the run on meeting a stop means and with a very small braking range of only a few centimeters; being easily recoverable if the engine stops operating accidentally by means of an automatic clutch means of the self-propelled device.

BRIEF DESCRIPTION OF THE DRAWINGS

The invention will now be further described, by way of example, with reference to the drawings, in which.

In the drawings, like parts are denoted by like reference numerals.

DESCRIPTION OF PREFERRED EMBODIMENTS

Figure 1:
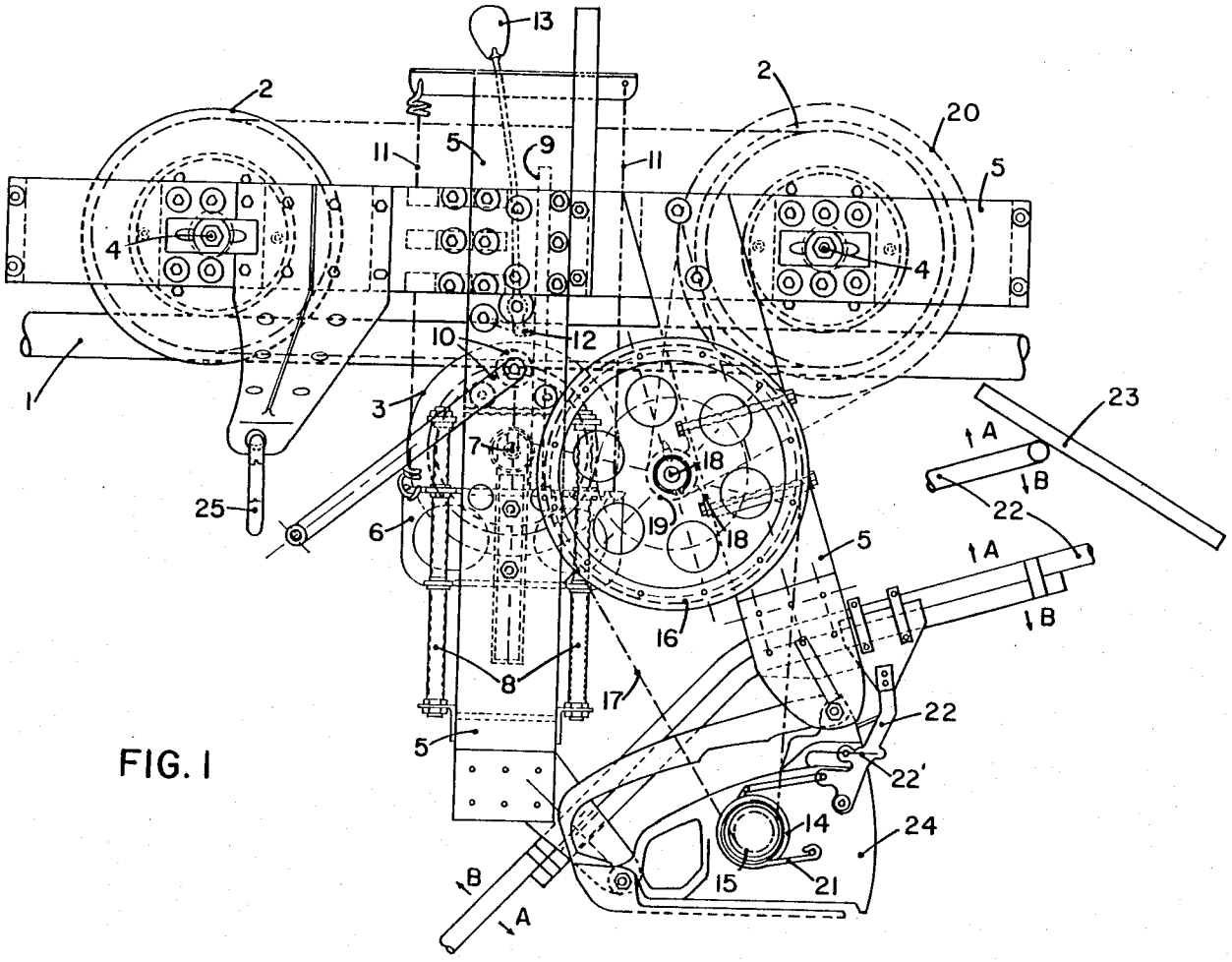
FIG. 1 is a diagrammatic side elevation of one embodiment of a self-propelled cable device according to the invention.

According to the basic design illustrated in FIG. 1, the self-propelled device is constituted by one or more wheels 2 applied by force to part of the upper half of the surface of a track cable 1 and one or more wheels 3 applied by force to part of the lower half of the surface of the track cable 1 and which roll on the latter. These wheels are applied by force to the track cable 1 by a device which forcibly moves together the wheels 3 below the cable 1 and the wheels 2 located above this cable in order to prevent any sliding when the equipment is pulling. All or some of these wheels can be driving wheels. The driving wheels can be positioned above the cable. The axles 4 of the driving wheels can be fixed to the frame 5 of the device or can be joined to the latter via a suspension. Non-driving or idler wheels 3 can be positioned below the cable and can be applied thereto by means of a device constituted by a trolley 6 fixed to the axle 7 of wheels 3 sliding on slides or guides 8 fixed to the frame 5. The trolley 6 can be displaced by a rack 9 which can be integral with or merely abut said trolley. The rack 9 is displaced by a gear fixed to a lever or crank 10. The wheels 3 positioned below the track cable 1 can be applied thereto by the action of one or more springs 11, whereof one end is joined to the trolley 6 and the other to the frame 5. To remove the equipment from the cable 1, the crank is operated manually, which has the effect of moving the wheels 3 away from the cable 1. The wheels can be kept in the disengaged position by the action of a catch 12 acting on the teeth of the rack 9 and preventing the latter from rising under the action of the springs 11. The rising of wheels 3, together with the application thereof to the track cable 1, takes place simultaneously through the manual actuation of a lever 13 integral with the catch 12, so as to disengage the latter from the teeth of the rack 9, thus freeing the rack—trolley—wheel assembly. It is also possible to increase the application force of the wheels 3 to the cable 1 by actuating the lever or crank 10 in the opposite direction from that used for disengaging the wheels 3.

If desired, it is also possible to use only the technique consisting of applying wheels 3 to cable 1 by the action of lever or crank 10 without using the springs 11 for raising the trolley 6. In place of the rack, it is possible to use a trolley hauling cable which is wound onto the shaft of the crank 10 and has the effect of raising or lowering the trolley 6 and forcibly applying the wheels 3 to the track cable 1. The wheels 3 can be maintained against the cable 1 by the action of a suitably positioned catch which, in the absence of a force applied to its control lever, passes between the teeth of a gear fixed to the shaft of the crank 10. As a result, the hauling cable of the trolley 6 is maintained under tension and consequently the wheels 3 are forcibly maintained against the cable 1. One or more springs can be inserted between the trolley and the trolley hauling cable. Thus, a downward movement of wheels 3 is possible so as to clear any sleeves on cable 1. Hydraulic or pneumatic jacks can also be used for applying pulleys or rollers to the cable 1.

Without exceeding the scope of the invention it is possible to use any other device for applying the wheels to the track cable 1. It is also within the scope of the invention to replace the wheels 2 and 3 by endless tracks, one or more of which is applied to the upper half of the surface of the track cable 1 and a further one or more of which is applied to the lower half of the surface of the cable 1. A combination of wheels and endless tracks can also be used for this purpose.

An internal combustion engine 24 may be provided whose rated output equals or exceeds 6000 r.p.m. so that it has a relatively light weight for a given power.

A centrifugal clutch 14 may be positioned on the output shaft of the engine, i.e. relating to the highest speed, in order that its dimensions are as small as possible for a given power to be transmitted. Using this centrifugal clutch 14 the engine is automatically uncoupled under throttled down conditions. As soon as the rotation speed increases, the engine is automatically coupled to the transmission. The centrifugal clutch 14 also automatically uncouples the engine from the transmission, when the load parallel to the forward travel direction of the equipment reaches the maximum prescribed value. It is also possible to use an electromagnetic hydraulic or pneumatic clutch.

In view of the disadvantages of reduction gears, namely due to their great weight, according to the invention, the transmission of power to the self-propelled device and the reduction of speed take place simultaneously by using as the reduction gear either belts and pulleys or chains with toothed wheels or a combination of belts and chains with pulleys and toothed wheels of different diameters. A small diameter pulley 15 can be fixed to the output of the centrifugal clutch 14 and rotate a large diameter pulley 16 via a toothed belt 17 forming the first part of the reduction gear. The spindle 18 of the large diameter pulley 16, which is fixed to the latter, can be supported by a bearing 18' fixed to the frame 5 in which it freely rotates. A small toothed wheel 19 fixed to the large diameter pulley 16 is able to rotate a large diameter toothed wheel 20 via a chain forming the last part of the reduction gear. The reduction gear can also have a larger number of parts. The final pulley or toothed wheel 20 of the reduction gear can be fixed to a driving wheel or an endless tread driving wheel of the self-propelled device. The driving wheels can be inter-connected by means of belts and chains.

According to the invention, the braking device can be a band brake. It can be located on the engine output shaft. It can also be incorporated into the centrifugal clutch 14 through a band 21 passing round the output cylinder of said clutch. One end of the band 21 is joined to the frame 5 and the other end to a lever 22. In the upper position, the lever 22 keeps the band away from the cylinder. In the lower position, the lever 22 pulls the end of the band which is not connected to the frame 5, which has the effect of decelerating the output cylinder of the centrifugal clutch 14. The braking device can be an electromagnetic, hydraulic or pneumatic brake.

According to the invention, if a centrifugal clutch 14 is used, the same lever 22 simultaneously acts on the brake and the accelerator. If an electromagnetic, hydraulic or pneumatic clutch is used, the same lever 22 simultaneously acts on the accelerator, brake and clutch.

According to the invention, with the engine started, to put the equipment into operation it is necessary to manually operate the lever 22 in direction A (FIG. 1) which has the effect of releasing the brake, accelerating the engine and coupling the engine to the transmission. The lever 22 is kept in the operating position by a device which can be a spring catch or a spring plate 22' with a stop notch which keeps the lever 22 in the operating position. When the equipment reaches the end of its travel, the level 22 strikes against a stop member 23 which can be fixed to the cable or elsewhere. This has the effect of disengaging it from the device which keeps it in the operating position and tilting it in the direction B to the stop position. As a result, the engine is decelerated, uncoupled from the transmission and the equipment is braked.

The geometry of the lever 22 can be variable and is bent to reduce the overall dimensions of the equipment during its transportation or various handling operations.

Figure 2:
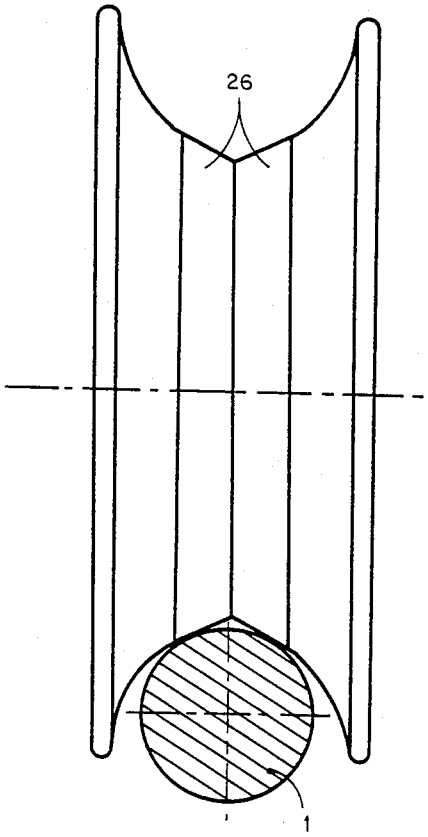
FIG. 2 is a side elevation of a wheel forming part of the device shown in FIG. 1.
Figure 3:
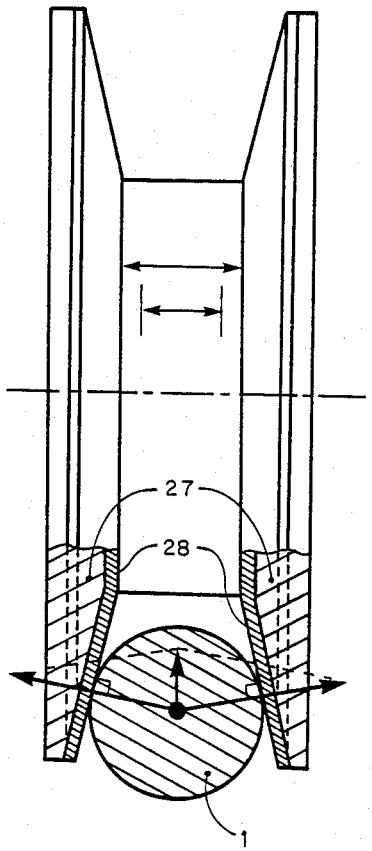
FIG. 3 is a cross-section through a modified form of the wheel shown in FIG. 2.

According to the invention, in order to obtain a perfect adhesion of the driving wheels on the cable 1, said wheels can be provided with a peripheral guidance groove having in cross-section an elastic material base 26 (FIG. 2). Another embodiment shown in cross-section (FIG. 3), the guidance groove can have two flanges 27 diverging outwardly, so as to obtain a very considerable clamping force on the contact surfaces between cable and wheel. The flanges 27 can move toward and away from one another in accordance with the cross-section of the track cable 1 via a control device (not shown). The flanges 27 may have an elastic material coating 28.

According to the invention, the equipment may or may not have a manually controlled forwards-backwards reversal device, which can be formed by a system of dogs or any other system known for this purpose. It can be positioned either directly at the engine output or in an intermediate position in the transmission.

The starter, accelerator, clutch and brake, together with the forwards-backwards movement reversal device can be separately or simultaneously remotely controlled or electrically controlled without exceeding the scope of the invention.

The equipment frame 5 can have one or more coupling members 25 for differently positioned loads.

To ensure a lightweight construction, the various components of the equipment can be made from light materials such as plastics, titanium, Duralumin, Alpax, and other light alloys.

Figure 4:
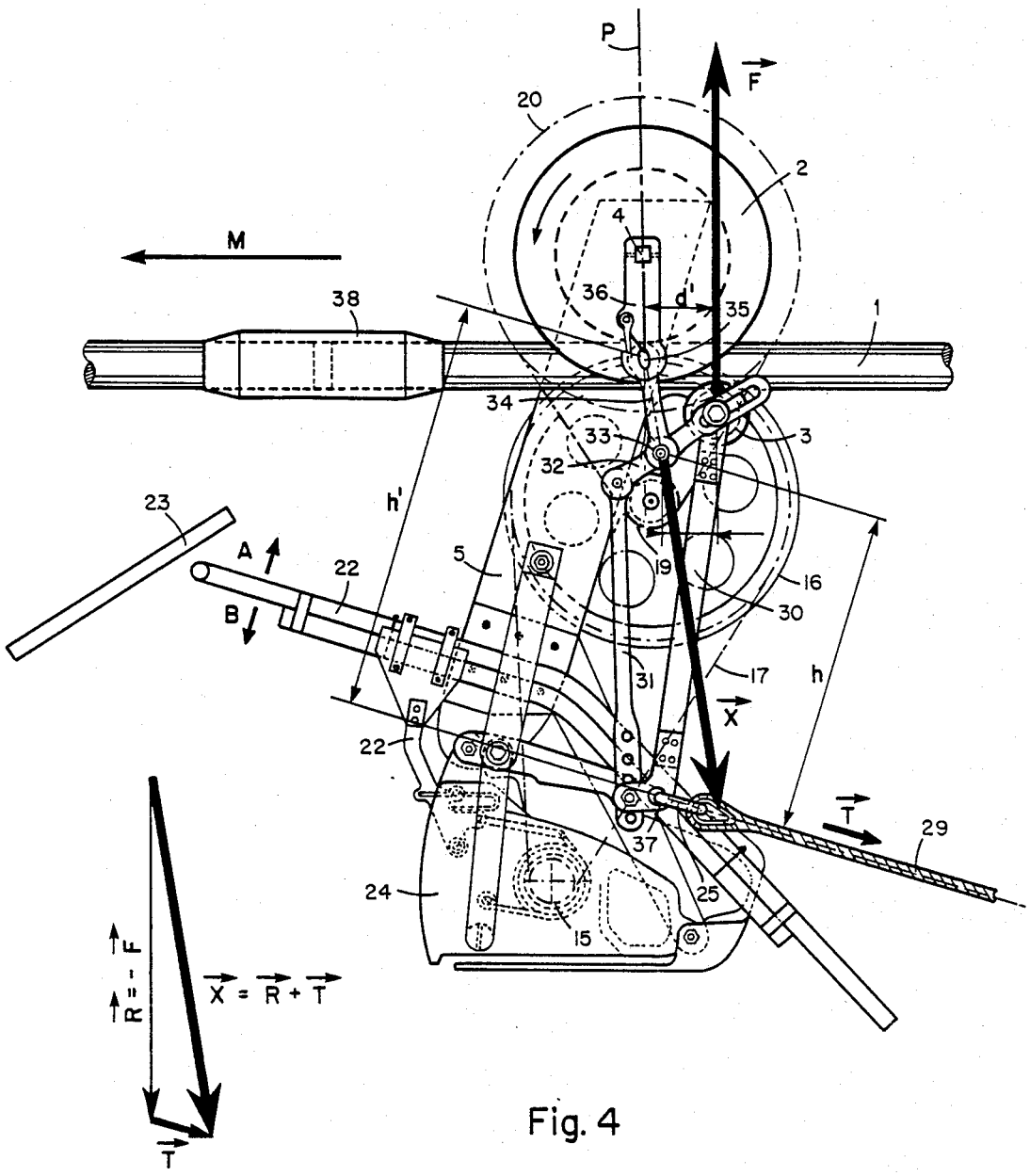
FIG. 4 is a diagrammatic side elevation of a second embodiment of a self-propelled device according to the invention.
Figure 5:
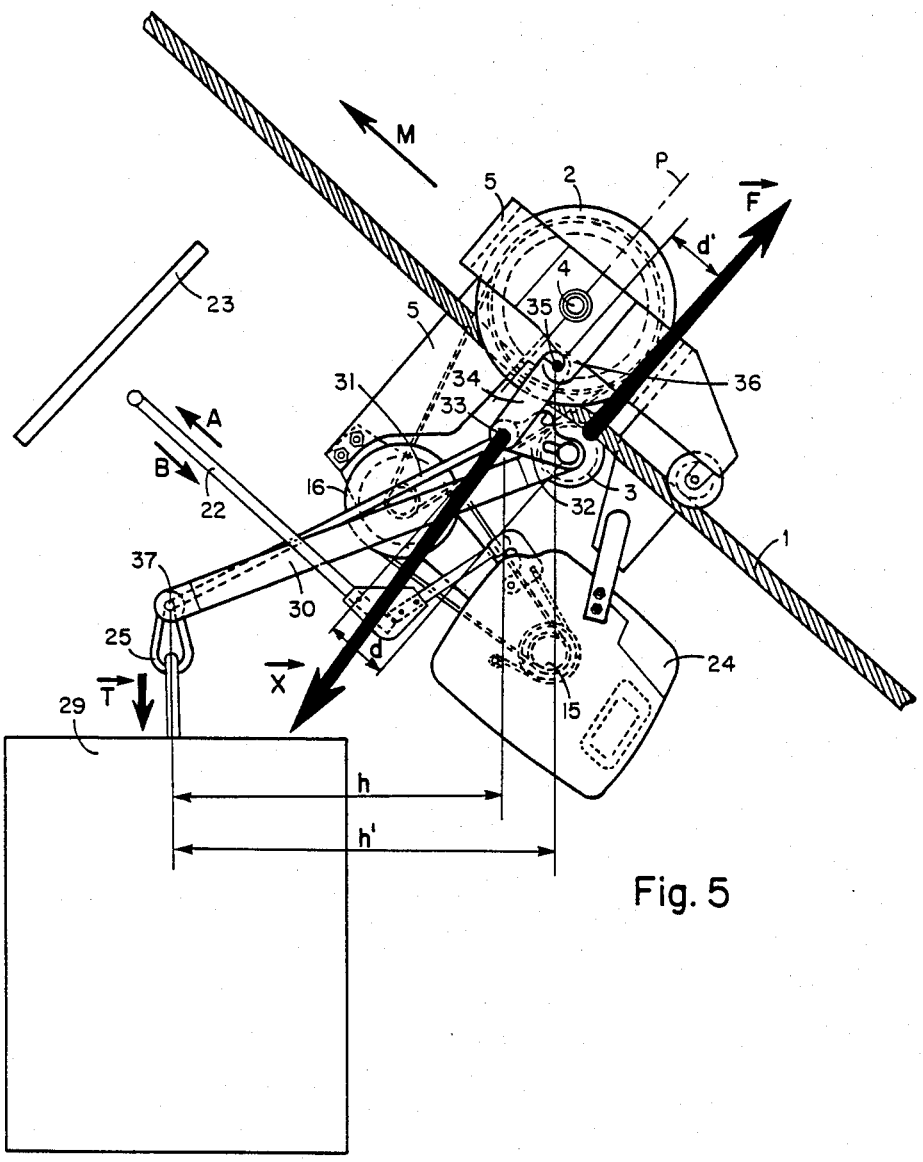
FIG. 5 shows a modification of the device shown in FIG. 4.

An alternative embodiment of a self-propelled device according to the invention is illustrated in FIGS. 4 and 5 of the drawings. This device comprises a driving wheel 2 located on the track cable 1 and a freely rotating wheel 3 positioned below the cable 1 as well as lever means connected to the engine frame such that an increase in the traction or the weight of the load results in an increase in the force with which the wheels or endless treads are supplied as shown in the above-identified U.S. Pat. No. 3,498,236. The load or small cable 29 is attached to a lever load formed by three arms 30,31 and 32 connected in a rigid manner. This lever is positioned beneath the track cable 1, and the arm 31, which is in traction, can alternatively be a chain or a cable.

The load lever pivots on its pivot pin 33, which is one of the two articulations of the two links 34 located on either side of the track cable 1. The links 34 pivot on their second articulation 35 connected to bearings 36 fixed to the frame 5. To give optimum performance and in contrast with the device of U.S. Pat. No. 3,498,236, the pivot pin 33 of the load lever and articulation 35 of the links are positioned on the same side as wheel 3 is applied to the cable 1 relative to an imaginary plane P passing through the axle 4 of the driving wheel 2 and perpendicular to the track cable 1. The axle of the wheel 3 located beneath the cable 1 is connected to the upper part of the load lever constituted by the three arms 30,31,32. The action of the load or traction $\vec{T}$ of the small cable 29 on the load lever is to forcibly apply the freely rotating wheel 3 beneath the cable 1, whilst also forcibly applying the driving wheel 2 to the cable 1 via links 34 acting on bearings 36 fixed to the frame. The axle of the wheel 3 applied to the cable 1 must be at an adequate distance from the pivot pin 33 of the load lever constituted by the three arms 30, 31 and 32 to enable the wheel 3 to strike against the cable 1 when the load lever pivots in the direction of the load or traction $\vec{T}$ of the small cable 29. d is the distance from the axle of the wheel 3 to the pivot pin 33 of the load lever measured parallel to the track cable 1. h is the distance from the load application or attachment point 37 of the cable 29 to the pivot pin 33 of the load lever measured perpendicular to the direction of the load or traction $\vec{T}$ of the cable 29. T is the absolute value of the cable load or traction $\vec{T}$. The absolute value of the application force $\vec{F}$ of the wheel 3 beneath the track cable 1 is: $F=(h/d)\times T$.

Therefore, the application force of the driving wheel 2 to the track cable 1 is the resultant $\vec{X}$ of the traction $\vec{T}$ of the small cable or load and of the reaction $\vec{R}=-\vec{F}$ of the cable 1 on the wheel 3 located beneath the cable.

The application force $\vec{X}$ of the driving wheel 2 to the cable 1 is transmitted via links 34 acting on bearings 36 fixed to the frame 5. One of the bearings 36 can be in the form of a hook so as to be able to disengage the equipment from the cable 1 by unhooking one of the links 34 from the corresponding bearing 36.

To bring about a good stability of the equipment, the articulation 35 of the links 34 on bearings 36 fixed to the frame 5 must preferably be in the vicinity of the line perpendicular to the cable 1 passing through the contact point of wheel 2 and cable 1.

To prevent an exaggerated pivoting of the load lever on its pivot pin 33, both the load lever and the links 34 are constructed in such a way that pivoting on the pivot pin 33 is limited. To this end, the load lever or the links 34 can have, for example, a stop catch, so that the load lever abuts against the links 34 at a given position thereof with respect to the links 34.

The assembly formed by the links 34 and the load lever abutting thereon pivots on the articulation 35 of links 34 on bearings 36 fixed to the frame 5. d' is the distance between the axle of the freely rotating wheel 3 located beneath the track cable and the articulation 35 of the links 34 on the bearings 36 fixed to the frame 5 measured parallel to the cable 1. h' is the distance between the attachment or load application point 37 of the small cable 29 and the articulation 35 of the links 34 on bearings 36 fixed to the frame 5 measured perpendicular to the force applied by the load or the traction T of the cable 29.

The absolute value of the application force $\vec{F}$ of the wheel 3 beneath the cable obtained by means of the assembly formed by links 34 and the load lever abutting thereon is:

$$f=(h'/d')\times T.$$

This self-propelled device brings about a dynamic clamping of the track cable 1, which is self-gripping, self-stabilizing, self-controlled and proportional to the load, which prevents any sliding.

The links 34 give the device for applying the driving wheel 2 to the track cable 1 a flexibility making it possible for the equipment to easily clear couplings 38 of the cable 1. The links 34 can be replaced by flexible members in the form of cables or small chains without exceeding the scope of the invention.

Through the use of the known materials (steel, Duralumin and plastic materials) it is possible to construct equipment with a total weight of 50 kg, a height of 50 cm and a width of 40 cm, with a hauling capacity of 1000 daN (decanewtons).

Due to its lightness, great manoeuvrability, small overall dimensions and simplicity of use, the equipment according to the invention can be used for the transportation of people and particularly soldiers having to cross difficult ground by means of a cable stretched between two trees or posts embedded in the ground in cases where a helicopter cannot be used for fear of attracting the attention of the enemy.

As a safety measure, in the case of an accidental locking of the driving wheel 2 by the brake before the equipment has completed its travel, high traction applied to the small cable 29 makes it possible to fracture a pin (not shown) on the load lever formed by the three arms 30,31 and 32. Such a pin can be positioned at the junction of the two arms 31 and 32 of the load lever. The fracture of such a pin leads to the deformation of the geometry of the load lever and to the moving away of the freely rotating wheel 3 from the cable 1, said load lever being articulated on the axle of the wheel 3.

To permit the adaptation of the equipment to different diameters of the cable 1, the geometry of the load lever formed by the three arms 30,31 and 32 can be regulated by varying the position of the spindles, bolts or pins that interconnect the three arms 30,31 and 32 in the recesses or oblong holes provided for this purpose.

The distance between the pivot pin 33 of the load lever and the axle of the wheel 3 positioned beneath the track cable 1 can be regulated varying the position of the axle of the wheel 3 positioned beneath the cable on the said load lever.

According to the invention, the driving wheel application device can be simplified by the elimination of the links 34 and by connecting the pivot pin 33 of the means lever to the frame 5. However, this device is inferior to that described hereinbefore with regard to its flexibility and its capacity to clear the coupling sleeves 38 of the cable 1.

In order to increase stability in all the self-propelled devices described hereinbefore, the equipment can have one or more supplementary wheels running along the surface of the track cable, as shown in FIG. 5, without exceeding the scope of the invention.

In addition, the equipment can have a device for the automatic limitation of the downward speed in the case of an engine failure on a steep slope. This device can be constituted by a centrifugal, hydraulic or aerodynamic brake.

With a view to a better utilization of the power of the engine 24 and a greater operating regularity, the power variation of the engine 24 can be controlled by the transported or hauled load in the following manner. The attachment member 25 of the transported or hauled load can be connected via a cable, chain or levers to the power variation control member of the engine 24. The load attachment member 25 can also be supported by a spring, whose elongation increases with the load. Therefore, the engine power varies as the transported or hauled load.

The engine 24 can be adapted from that of a wood cutting or sawing apparatus, so as to permit clearing the forest and undergrowth from the path of the equipments by removing the engine and fitting corresponding cutting members.

The equipment can also have an electric motor supplied with power by a hook suspended on the track cable by movable hooks. The power supply can be provided by the actual cable, of which there would be two for a single-phase current or three for a three-phase current.

The invention is not restricted to the above described embodiments but modifications may be made without departing from the scope of the invention as defined by the appended claims.

I claim:

1. In a self-propelled device adapted for travelling on a track cable (1), comprising a frame (5), a driven wheel (2) that is rotatably mounted on the frame and that bears on the upper surface of the rack cable (1), and means carried by said frame (5) for forcing said wheel (2) against the rack cable (1), said means comprising lever means which carries an axle of an idler wheel (3) that bears against the underside of the track cable a distance from point of contact of said driven wheel (2) with said track cable (1) and means (25) for connection to a load (29) to be borne, such that an increase in the load swings the lever means in a direction to increase the force with which the wheels (2 and 3) are applied against the track cable; the improvement comprising means pivotally interconnecting said lever means with said frame (5) about an axle (33), both said latter axle (33) and said idler wheel (3) being located on the same side of a plane (P) containing the axis (4) of rotation of said driven wheel (2) and perpendicular to said track cable (1), said side of the plane (P) being the side that faces in said direction.

2. A self-propelled device as claimed in claim 1, in which suspension means for said axle comprise links in the form of rigid members having two articulation points.

3. A self-propelled device as claimed in claim 1, in which suspension means for said axle comprise suspension members in the form of small flexible members.

4. A self-propelled device as claimed in claim 1, in which said axle (33) of said lever is suspended from said frame (5) by lins (34).

5. A self-propelled device as claimed in claim 1, in which said axle (33) of said lever means is disposed below said track cable.

6. A self-propelled device as claimed in claim 1, in which a band brake is provided constituted by a cylinder (14) secured to an axle of a transmission device and a flexible band (21) disposed about said cylinder (14), one end of said flexible band (21) being secured with respect to said frame (5) which carries said transmission device, the other end of said band (21) being secured to a control lever (22).

7. A self-propelled device as claimed in claim 1, and a drive motor (24) carried by said frame (5).

* * * * *